US010134257B2

(12) United States Patent
Zhang et al.

(10) Patent No.: US 10,134,257 B2
(45) Date of Patent: Nov. 20, 2018

(54) CAVITATION LIMITING STRATEGIES FOR PUMPING SYSTEM

(71) Applicant: Caterpillar Inc., Peoria, IL (US)

(72) Inventors: Yanchai Zhang, Dunlap, IL (US); Zhaoxu Dong, Dunlap, IL (US); Xuefei Hu, Dunlap, IL (US)

(73) Assignee: Caterpillar Inc., Deerfield, IL (US)

( * ) Notice: Subject to any disclaimer, the term of this patent is extended or adjusted under 35 U.S.C. 154(b) by 224 days.

(21) Appl. No.: 15/229,673

(22) Filed: Aug. 5, 2016

(65) Prior Publication Data

US 2018/0040226 A1 Feb. 8, 2018

(51) Int. Cl.

| | |
|---|---|
| ***F04B 11/00*** | (2006.01) |
| ***G08B 21/18*** | (2006.01) |
| ***E21B 43/267*** | (2006.01) |
| ***F04B 17/05*** | (2006.01) |
| ***F04B 49/06*** | (2006.01) |
| ***F04B 49/10*** | (2006.01) |
| ***F04B 51/00*** | (2006.01) |
| ***F04B 53/14*** | (2006.01) |
| ***F04B 53/16*** | (2006.01) |
| ***F04B 53/22*** | (2006.01) |

(52) U.S. Cl.

CPC ..... *G08B 21/182* (2013.01); *E21B 43/267* (2013.01); *F04B 11/0041* (2013.01); *F04B 17/05* (2013.01); *F04B 49/065* (2013.01); *F04B 49/103* (2013.01); *F04B 51/00* (2013.01); *F04B 53/14* (2013.01); *F04B 53/16* (2013.01); *F04B 53/22* (2013.01); *F04B 2205/02* (2013.01); *F04B 2205/03* (2013.01)

(58) Field of Classification Search

CPC ..... F04B 11/0041

See application file for complete search history.

(56) References Cited

U.S. PATENT DOCUMENTS

| | | | | |
|---|---|---|---|---|
| 6,260,004 | B1 * | 7/2001 | Hays | G05B 23/0235 702/130 |
| 6,464,464 | B2 * | 10/2002 | Sabini | F04D 15/0066 318/432 |
| 6,663,349 | B1 * | 12/2003 | Discenzo | F04D 15/0245 417/300 |
| 6,709,240 | B1 * | 3/2004 | Schmalz | F04B 49/065 318/432 |
| 6,882,960 | B2 * | 4/2005 | Miller | F04B 51/00 702/177 |

(Continued)

FOREIGN PATENT DOCUMENTS

| | | | |
|---|---|---|---|
| DE | 19645129 A1 * | 5/1998 | F04D 15/0066 |
| EP | 2065584 | 8/2011 | |

OTHER PUBLICATIONS

Cavitation in reciprocating pumps, by Sahoo, published 2006.*

*Primary Examiner* — Charles Freay
*Assistant Examiner* — Thomas Fink
(74) *Attorney, Agent, or Firm* — Mattingly Burke Choen & Biederman

(57) ABSTRACT

Operating a pumping system includes moving a pumping element to transition liquid through the pump, and determining a value based at least in part upon inlet pressure and pumping speed that is indicative of a pressure of the liquid within a bore susceptible to cavitation. Pumping speed and/or inlet pressure can be varied responsive to the determined value to limit cavitation.

10 Claims, 4 Drawing Sheets

(56) References Cited

U.S. PATENT DOCUMENTS

| | | | | |
|---|---|---|---|---|
| 7,797,142 | B2 | 9/2010 | Solomon | |
| 8,543,245 | B2 | 9/2013 | Heltman | |
| 9,091,259 | B2 | 7/2015 | Tamminen | |
| 2004/0199480 | A1* | 10/2004 | Unsworth | F04D 15/0077 706/16 |
| 2014/0039805 | A1* | 2/2014 | Sharpe, Jr. | F04D 15/0088 702/24 |
| 2015/0135809 | A1 | 5/2015 | Nohmi | |
| 2016/0032703 | A1* | 2/2016 | Broussard | E21B 43/26 166/250.01 |

* cited by examiner

CAVITATION LIMITING STRATEGIES FOR PUMPING SYSTEM

TECHNICAL FIELD

The present disclosure relates generally to limiting cavitation in a pumping system, and relates more particularly to limiting cavitation by varying pumping speed or inlet pressure based on an indirect determination of a liquid pressure within the pump.

BACKGROUND

Pumps are used in all manner of commercial, industrial, and household applications, from small pumping mechanisms in household appliances up to large scale industrial and resource extraction systems, for example. While there are nearly as many different types of pump designs as there are pump applications, two common pump types are reciprocating pumps and rotary pumps. In a rotary pump, an impeller is commonly provided to suck liquid into the pump housing and discharge it at a pump outlet for whatever the end use might be. Reciprocating pumps generally include one or more plungers that travel in a linear manner, alternating between an intake stroke and a pumping stroke. Other known pumps include diaphragm pumps, rotary vane pumps, and still others.

In many applications, pumps operate to transfer a liquid without concern for varying a pressure of the liquid, with the primary purpose being simply to move the liquid from one place to another. In certain other applications it can be desirable to use a pump to increase the pressure of a liquid. Pumps used in hydraulic systems for working equipment or industrial systems, pressure washers, and hydraulic fracturing pumps to name a few examples generally increase the pressure of the working liquid at least several times, and potentially many times, over the pressure at which the liquid is supplied. Such pumps commonly operate under relatively harsh conditions, often reciprocating at high speeds and subjecting internal components to fairly extreme pressures.

In some instances, including some of the more heavy duty applications, the well-known phenomenon of cavitation can occur within the pump. In cavitation a transient bubble of vapor forms in the liquid and then collapses, producing a shockwave of sorts. While the results of cavitation in the nature of erosion, pitting, cracking or other damage to pump components are readily recognized, the physics behind cavitation and the circumstances that can lead to cavitation have long defied attempts at a deeper understanding. Complicating prior attempts at analysis is the diversity of pump designs and even variations in pump and working fluid behavior across the various different types of fluids that can be used. Commonly-owned U.S. Pat. No. 7,797,142 to Salomon et al. is directed to simulating cavitation damage, and proposes a computer-implemented method that simulates a potential for cavitation damage, and displays a histogram in which locations of vapor implosion pressure events can be visually distinguished on a surface of a modeled component.

SUMMARY OF THE INVENTION

In one aspect, a method of operating a pumping system includes moving a pumping element in a pump to transition a liquid between a pump inlet and a pump outlet in the pump, and receiving inlet pressure data indicative of an inlet pressure of a liquid at the pump inlet, and pumping speed data indicative of a pumping speed of the pump. The method further includes determining a pressure value based at least in part on the inlet pressure data and the pumping speed data that is indicative of a pressure of the liquid within a bore in the pump susceptible to cavitation of the liquid. The method still further includes varying at least one of the pumping speed or the inlet pressure, responsive to the determined value.

In another aspect, a method of setting up a pumping system for service includes populating a data structure with a plurality of bore pressure values indicative of a pressure of a liquid in a bore within a pump of the pumping system positioned fluidly between a pump inlet and a pump outlet. The method further includes mapping the plurality of bore pressure values in the data structure to a plurality of inlet pressure values indicative of a pressure of the liquid at the pump inlet and a plurality of pumping speed values indicative of a pumping speed of the pump, such that bore pressure varies in a manner that is dependent upon both inlet pressure and pumping speed. The method further includes generating a cavitation threshold model that is based on a subset of the plurality of bore pressure values and a vapor pressure of the liquid. The cavitation threshold model defines an operating curve for the pump, such that upon operating the pump according to the operating curve cavitation of the liquid within the bore is limited.

In still another aspect, a pumping system includes a pump having a pumping element movable within a bore in a pump housing to transition a liquid between a pump inlet and a pump outlet in the pump housing. The pumping system further includes a control system coupled with the pump and having a first monitoring mechanism structured to monitor a first parameter indicative of an inlet pressure at the pump inlet, a second monitoring mechanism structured to monitor a second parameter indicative of a pumping speed of the pump, and an electronic control unit. The electronic control unit is coupled with each of the first monitoring mechanism and the second monitoring mechanism and structured to determine a pressure value indicative of a pressure of the liquid within the bore based at least in part on the inlet pressure and the pumping speed indicated by the first monitoring mechanism and the second monitoring mechanism, respectively. The control system further includes a cavitation alert device structured to produce an operator-perceptible alert indicative of expected cavitation of the liquid within the bore, and the electronic control unit being coupled with the operator alert device and structured to activate the operate alert device responsive to the determined value.

DETAILED DESCRIPTION

Figure 1:
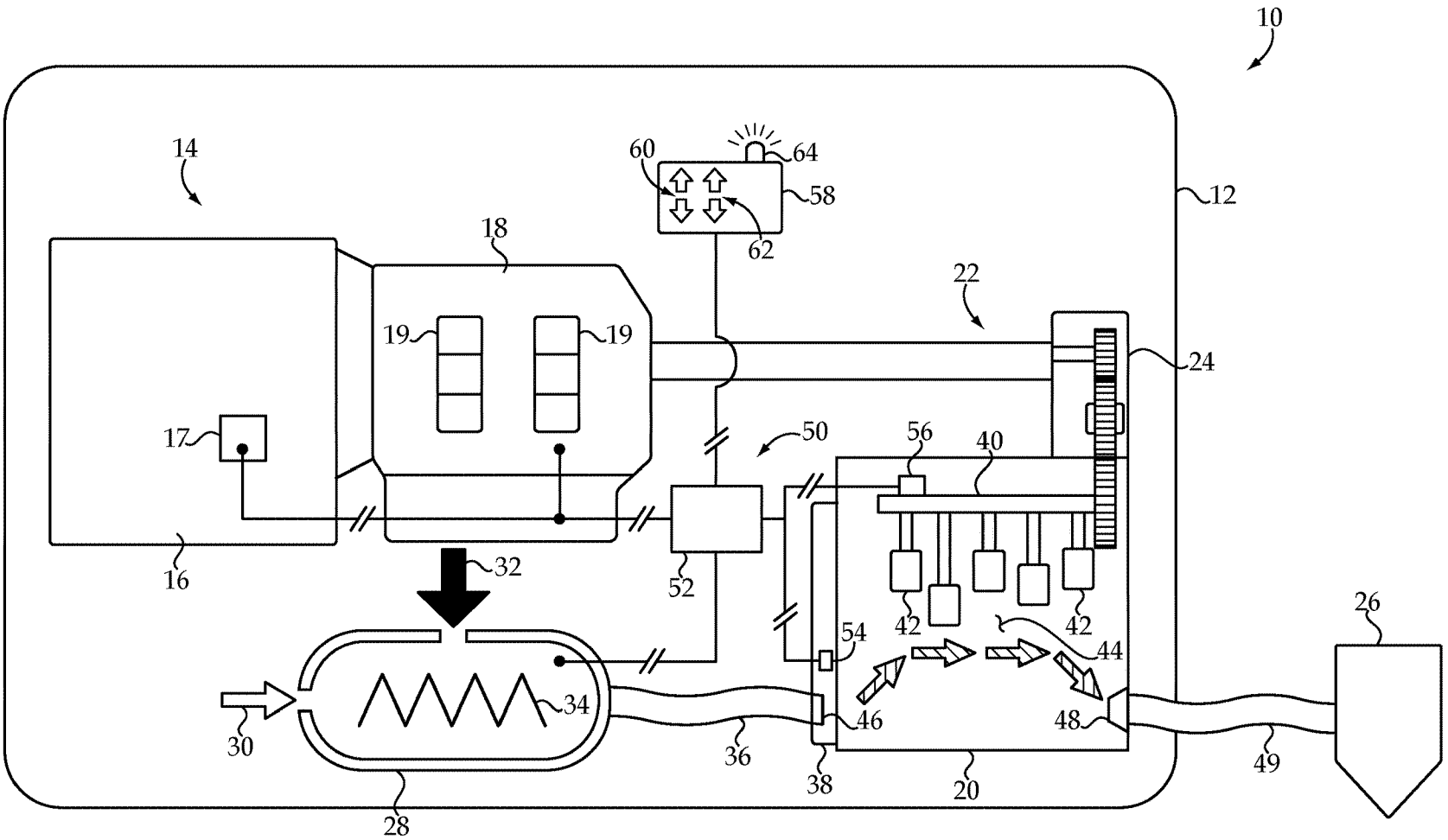
FIG. 1 is a diagrammatic view of a pumping system, according to one embodiment.

Referring to FIG. 1, there is shown a pumping system 10 according to one embodiment, and illustrated in the context of a fracking rig or the like having a frame 12 supporting a number of pumping system components. The frame 12 could include the bed of a mobile vehicle such as a truck or a towed trailer in certain embodiments, or could be a stationary structure. In still other instances, various components of the pumping system 10 might not be commonly supported at all. The pumping system 10 includes a power supply 14 having an engine 16, such as a conventional diesel internal combustion engine, coupled with a transmission 18 having a plurality of transmission gears 19. A driveline 22 couples the transmission 18 with a gearbox 24 coupled with and structured to drive a pump 20. In the illustrated embodiment, the pump 20 includes a reciprocating pump having a plurality of pumping elements such as plungers 42, each movable in suction or intake strokes and pumping strokes to transition a liquid between a pump inlet 46 and a pump outlet 48. An injection mechanism 26, such as for hydraulic fracturing, may be fluidly coupled with the pump 20 by way of a fluid conduit 49. A working liquid is supplied by way of another fluid conduit 36 to a manifold 38 of the pump 20, and distributes the working liquid to a plurality of pumping chambers or bores, within the pump 20 and diagrammatically depicted via numeral 44. In one practical implementation strategy the working liquid can include a suspension, including water, a lubricant, and a proppant. For ease of description hereinafter references to a liquid or the liquid or the working liquid should be understood as not excluding the presence of other constituents such as solids, or the use of multiple different liquids in the form of a solution or an emulsion. It should thus be appreciated that the present disclosure is not limited to any particular liquid, although those skilled in the art will appreciate that various different liquids, including so-called fracking fluid, may have a variety of compositions each of which may behave slightly differently with respect to cavitation and limiting cavitation as further described herein. The mixer 28 may include a mixing mechanism 34 that produces a mixture of a proppant 32 and one or more liquids 30, and feeds the mixture containing the liquid 30 and the proppant 32 from the mixer 28 to the pump 20 by way of the fluid conduit 36.

The pumping system 10 further includes a control system 50 having an electronic control unit ("ECU") 52 that is structured to monitor and control various of the operating aspects of the pumping system 10. The electronic control unit or ECU 52 may be in communication with the transmission 18 so as to shift gears either autonomously or at the command of an operator. The ECU 52 may also be in communication with a throttle 17 of the engine 16 for analogous purposes of varying engine speed. The control system 50 may further include a sensor 54 such as a pressure sensor coupled with the pump 20, for example coupled to the manifold 38, and structured to monitor a parameter indicative of an inlet pressure at or close to the pump inlet 46. The control system 50 may also include a sensor 56 such as a speed sensor structured to monitor a parameter indicative of a speed of rotation of a crankshaft 40, for example, so as to produce pumping speed data indicative of a pumping speed of the pump 20. The pressure sensor 54 likewise produces inlet pressure data indicative of a pressure of the liquid at or close to the pump inlet 46. The description herein of the inlet pressure data and pumping speed data should not be taken to mean that the data is necessarily a direct representation or indication of the parameter of interest, but could be data that is indicative indirectly of a state of the parameter of interest. All that is contemplated is that the ECU 52 can receive data from the sensor 54 and data from the sensor 56 and determine or estimate or infer a pumping speed or an inlet pressure as the case may be.

The control system 50 also includes an operator interface 58 having pumping speed controls 60 and inlet pressure controls 62. In a practical implementation, during a hydraulic fracturing operation, or another operation where the pumping system 10 is being used, an operator can monitor the status of factors such as inlet pressure and pumping speed, and based upon alerts or other information provided by way of the operator interface 58 can adjust inlet pressure or pumping speed to various ends. As will be further apparent from the following description, an operator or the control system 50 itself, whether onboard the pumping system 10 or located elsewhere, can advantageously control either or both of inlet pressure and pumping speed to enable the pumping system 10 to operate relatively close to a cavitation threshold with reduced risk of any significant cavitation occurring. Thus, an operator may have a better understanding of how to operate a pumping system to increase productivity while reducing the chances of cavitation. Analogously, a pumping system control system as contemplated herein can be structured for increased productivity.

Figure 2:
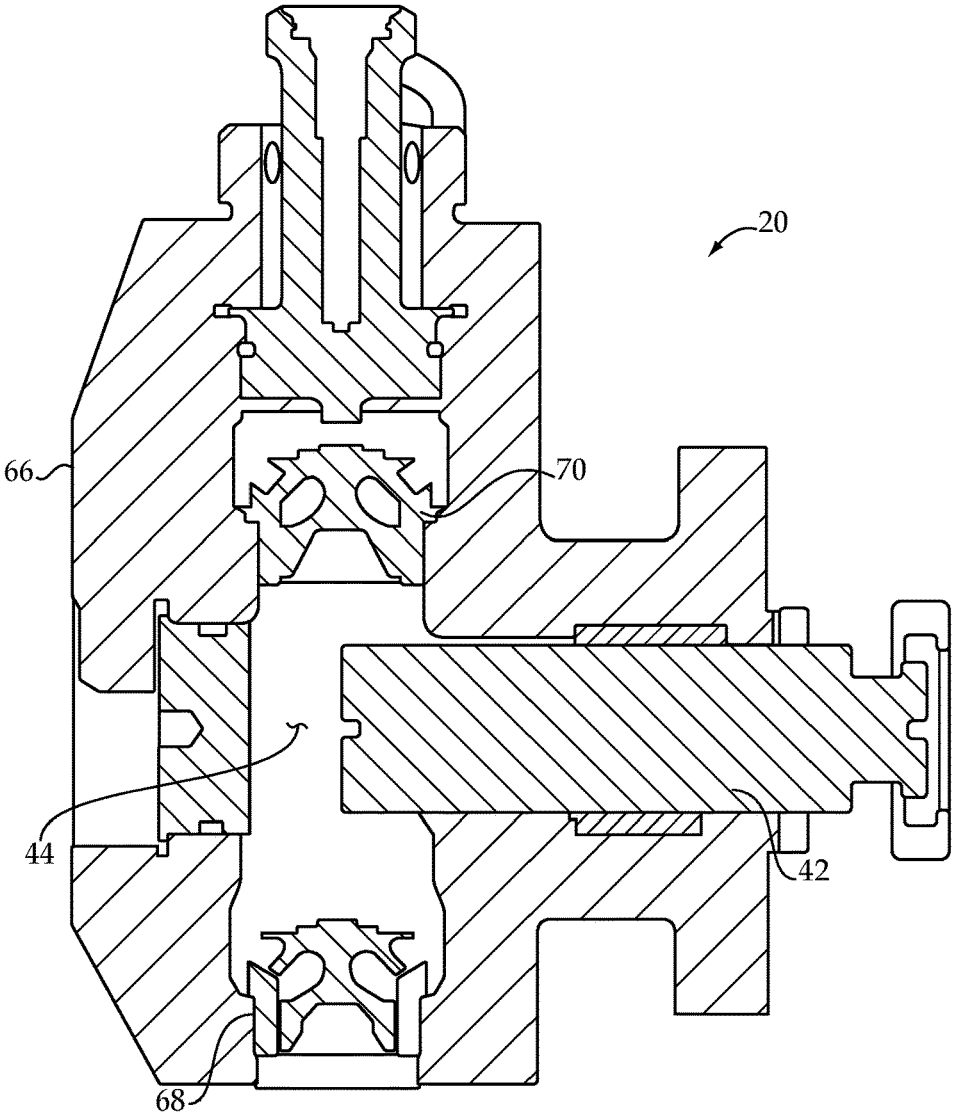
FIG. 2 is a sectioned side view of a pump suitable for use in the pumping system of FIG. 1.

Referring also now to FIG. 2, there is shown the pump 20 in a sectioned view where it can be seen that a plunger 42 is positioned to reciprocate within the bore 44 in the pump housing 66. The bore 44 extends within the pump housing 66, with communication between the bore 44 and the pump inlet 46 or the pump outlet 48 being controlled by the position of an inlet valve 68 or an outlet valve 70, respectively. It should be appreciated that while only a single plunger 42 is illustrated in FIG. 2, common commercial applications will include a plurality of similar or identical plungers. Embodiments are contemplated where a pump such as the pump 20 has a plurality of plungers that each receive the working liquid from a common manifold, and discharge pressurized working liquid to a common outlet manifold. In certain instances, pumps designed or operated according to the present disclosure could include staged pumping, only a single pumping element, outlet metering, inlet metering, a swash plate, or a variety of other hardware and operating or control configurations. As will also be apparent from the following description, the present disclosure contemplates a unique strategy for setting up a pumping system such as the pumping system 10 for operation.

Figure 3:
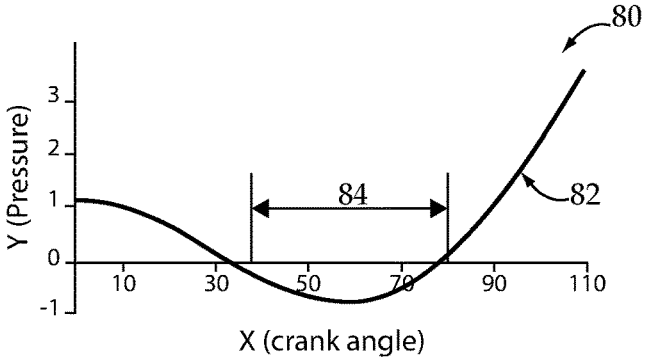
FIG. 3 is a graph illustrating pumping system operating conditions associated with cavitation.

Referring now to FIG. 3, there is shown a graph 80 where a pressure curve 82 that represents a bore pressure in a reciprocating plunger pump is shown in relation to crank angle on the X-axis and pressure on the Y-axis. The units on the X-axis can be understood generally to correspond to crank angles, whereas the units on the Y-axis can be understood generally to correspond to bore pressure values. At a Y value of zero, the pressure may be equal to a vapor pressure of the liquid. It can therefore be seen that the pressure curve 82 can drop below the vapor pressure during an approximately 40° span 84 of the crank angle. Another way to understand the principles shown in the graph 80 is that bore pressures can vary considerably during reciprocation of the plunger, and due to various losses as well as the travel of the plunger during a suction or intake stroke, the bore pressure can actually become lower than the vapor pressure of the liquid, and cavitation may have a tendency to occur to varying degrees. Thus, during the span 84 of the crank angle range in a pumping cycle, cavitation of the liquid being transitioned between the pump inlet and the pump outlet is generally more likely. While the general relationship between the tendency for cavitation to occur and conditions where bore pressure equals or is less than vapor pressure have long been recognized, in practice indirectly detecting conditions where cavitation is likely has proven to be substantially more complicated. The present disclosure reflects insights relating to properties of pump operation that can be exploited in theoretical modeling as well as practical pumping system design and operation.

To this end, it has been discovered that bore pressure in a pump can be related to pumping speed and inlet pressure according to the following Equation 1:

$$P_{bore}=P_{in}-[G]-[X]v^{7/4}_{plunger}-[Y]a_{plunger}-[Z]v^{2}_{plunger}$$

where:

$P_{bore}$=pressure in the bore;

$P_{in}$=inlet pressure;

v=plunger velocity;

a=plunger acceleration; and

G, X, Y, Z are numeric coefficients dependent upon at least one of a density of the liquid, a viscosity of the liquid, or a structural attribute of the pump.

As a liquid is conveyed through a pump, the pressure of the liquid within a bore in the pump positioned fluidly between the pump inlet and the pump outlet can vary from inlet pressure according to a plurality of loss terms, at least under certain operating conditions. Plunger velocity and acceleration can be determined from knowledge of construction of the pump 20 and the monitored pumping speed. In the case of the above Equation 1, when a plunger such as the plunger 42 is positioned approximately half-way between its two end of stroke positions, the pressure within the bore 44 may be reduced from the inlet pressure according to a gravitational loss term G, a frictional loss term $[X]v^{7/4}$, an inertial loss term $[Y]a_{plunger}$, and a structural loss term $[Z]v^{2}_{plunger}$. The gravitational loss term can also be considered as a structural loss term given that the gravitational loss term may be based upon a vertical distance that liquid being pumped must be raised from a pump inlet to the bore in which the pressure of the liquid is sought to be determined. Accordingly, the gravitational loss term can be understood as based upon a structural attribute of the pump that includes the rise distance from the pump inlet to the bore. The gravitational loss term will have a higher value where the vertical rise is greater, and a lower value where the vertical rise is lower. Depending upon pump and pumping system configuration, the gravitational loss term might in fact have a positive value, such as where the liquid falls a vertical distance from the pump inlet into the bore.

The frictional loss term can be understood to be based upon viscosity of the liquid being pumped, and also upon a flow distance from the pump inlet to the bore whose pressure is sought to be determined. Accordingly, a relatively longer flow distance for a given liquid could be associated with a relatively greater value of the frictional loss term, and a shorter flow distance could be associated with a lesser value of the frictional loss term. The diameter of the inlet passage defining the flow length could also affect the magnitude of the frictional loss term, due to variation in pipe friction with variation in the diameter.

The inertial loss term can be understood to be based upon a density of the liquid being pumped, as well as a length of the path to the bore from the pump inlet, and also on the basis of the diameter of the inlet pipe. The structural loss term $[Z]v^{2}_{plunger}$ may include a valve loss term that is based upon the opening size of the pump inlet, as determined by the geometry and position of an inlet valve. In the case of the inlet valve 68 in the pump 20, an opening position of the valve can affect the available flow area for liquid entering the bore 44, which available flow area will be less than an available flow area of the inlet passage.

The loss terms in the above Equation 1 will each include a numerical coefficient as noted, and in the above-illustrated case numerical coefficients G, X, Y and Z. The values of the numerical coefficients can be theoretical or empirically determined for a particular pump which is sought to be operated or evaluated or set up for service according to the present disclosure. Information as to the density and viscosity of a liquid of interest can also be empirically determined; or determined by consultation of outside references. It will therefore be appreciated that values of the numerical coefficients can vary depending upon the particular pump and the particular liquid of interest, however, the above Equation 1 is contemplated to be applicable across a range of pump types, including reciprocating pumps as well as rotary pumps, and a range of working liquid types as well. The understanding set forth herein as to the relationships among inlet pressure, pumping speed, and bore pressure can be exploited in operating a pump and pumping system according to the present disclosure and setting up the same for service. In particular, readily measured parameters including pumping speed and inlet pressure can be used to predict a bore pressure or a pressure value indicative of the bore pressure. The determined value may be a numeric value, for example, that indicates bore pressure in pounds per square inch (PSI), although the present disclosure is not thereby limited. The bore pressure, or potentially pressure in another bore within a pump, can be compared to a vapor pressure of the liquid being pumped, or to another value having a known relationship with the vapor pressure, to determine or predict when cavitation is expected. This enables a pump to be operated at a relatively higher pumping speed or a relatively higher inlet pressure, or both, with reduced risk of cavitation, and with reduced need for a safety buffer from the cavitation threshold.

Embodiments are contemplated wherein a computer such as the ECU 52 calculates a bore pressure based upon pumping speed and inlet pressure, however, in a practical implementation the above Equation 1 and associated principles can be used in populating a map for use in controlling or monitoring the operation of a pump. In the case of the pumping system 10, an operator can control pumping speed and potentially inlet pressure of the pump 20, and monitor operation of the pump 20 on the operator interface 58. The operator can use the pumping speed controls 60 and/or the inlet pressure controls 62 to adjust operation of the pump 20 as desired to optimize operation while avoiding risk of cavitation. Varying pumping speed could include shifting gears or changing engine speed. Varying inlet pressure could include adjusting mixer 28 to vary its outlet pressure. When a risk of cavitation is detected, or potentially actual cavitation is detected, the ECU 52 may output an activation signal to the alert device 64 to produce an operator-perceptible alert such as illumination of a light, sounding of an alarm, et cetera. The operator could also be provided with various indications that the pump 20 is operating according to safe conditions where cavitation is not expected, and a green light could be turned off, for instance, when what is considered a safe pumping speed and/or a safe inlet pressure is exceeded. As further described herein, bore pressure values calculated according to the principles set forth herein can be used to generate a cavitation threshold model that defines an operating curve for the pump 20 that can be used either by visual reference by an operator or by the ECU 52. These principles will be further illustrated by way of the description of the following example embodiments.

INDUSTRIAL APPLICABILITY

Figure 6:
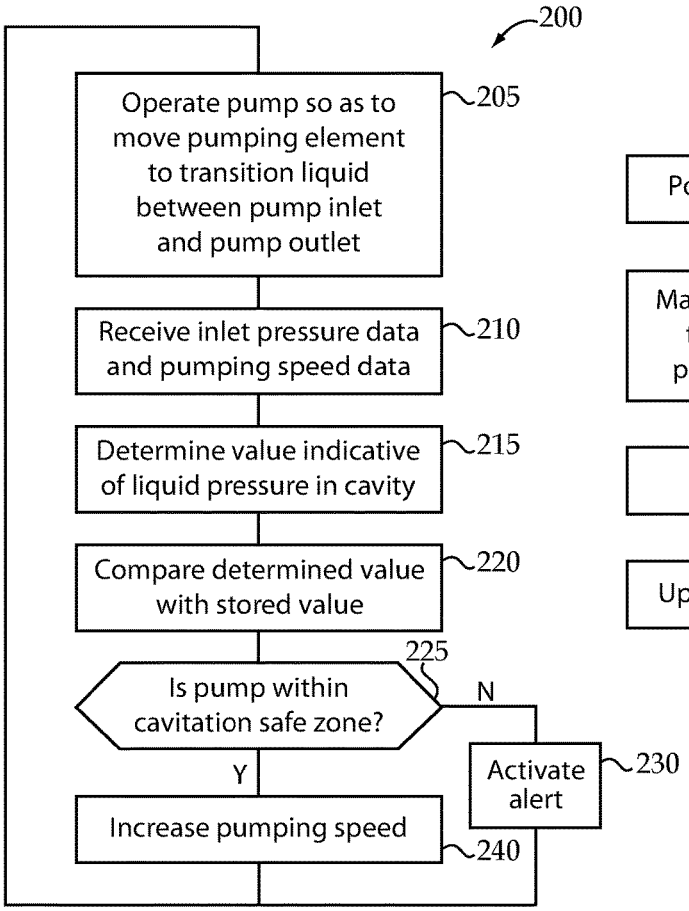
FIG. 6 is a flowchart illustrating an example process, according to one embodiment.

Referring to the drawings generally, but in particular now to FIG. 6, there is shown a flowchart 200 illustrating example process and control logic flow according to the present disclosure. At block 205, the pump 20 is operated so as to move the plunger 42 to transition liquid between the pump inlet 46 and the pump outlet 48. From the block 205 the process may advance to block 210 to receive inlet pressure data and pumping speed data. As described herein, the ECU 52 may receive data from the sensor 54 that is indicative of liquid pressure in the manifold 38, and data from the sensor 56 that is indicative of the pumping speed, namely, a Rotations Per Minute ("RPM") of the pump 20. From the block 210, the process may advance to the block 215 to determine a value indicative of liquid pressure in the bore 44. From the block 215, the process may advance to block 220 to compare the determined value with a stored value indicative of a vapor pressure of the liquid. The stored value may be a pressure value that is determined according to the operating curve of the pump 20, as further described herein. From the block 220, the process may advance to a block 225 to query is the pump 20 within a cavitation safe zone? The cavitation safe zone could be a zone of operation determined by combinations of pumping speed and bore pressure that reside on one side of the pump operating curve. The opposite side of the pump operating curve could be considered a zone of expected cavitation. If no, the process may advance to block 230 to activate the alert device 64 as described herein. If yes, the process may advance to a block 240 to increase pumping speed, such as by switching gears in the transmission 18 and/or adjusting the throttle 17 to increase a speed of the engine 16.

The process depicted in the flowchart 200 can be understood as monitoring of cavitation risk during increasing the pumping speed of the pump 20. By looping through the process of the flowchart 200 continuously or periodically pumping speed can be brought up to or close to a maximum allowable pumping speed, at which point the alert device 64 can be activated. There are a variety of other ways that pumping speed control could occur according to the present disclosure, as well as a variety of ways that inlet pressure control could take place either in parallel with or instead of varying pumping speed. It is nevertheless assumed that in many instances, an operator or the ECU 52 will seek to operate the pump 20 at as high a pumping speed as possible without risking or unduly risking cavitation. Rather than increasing the pumping speed at the block 240, a control process according to the present disclosure could seek to operate the pump 20 at a setpoint, and thus pumping speed could be either increased or decreased. In the case of a hydraulic fracturing application, the operator or the ECU 52 might control pump operation in the manner described for a relatively short time period, on the order of only a few minutes, to complete the hydraulic fracturing event, and then pump 20 appropriately operated to discontinue pumping liquid at all.

Figure 7:
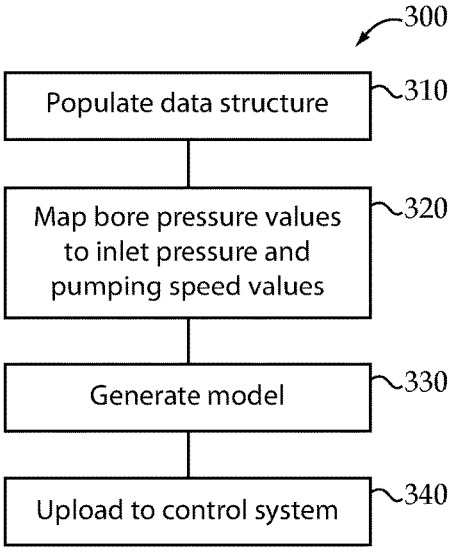
FIG. 7 is a flowchart illustrating another example process, according to one embodiment.

As indicated above, it is contemplated that the principles and discoveries set forth in the present disclosure can be applied to setting up a pumping system such as the pumping system 10 for operation. Referring to FIG. 7, there is shown a flowchart 300 illustrating steps in an example setup process according to the present disclosure. The setting up of the pumping system 10 can include populating a data structure, any suitable data structure such as an associative array in a computer readable memory, with a plurality of bore pressure values indicative of a pressure of a liquid in the bore 44 within the pump 20 of the pumping system 10, with the bore 44 being positioned fluidly between the pump inlet 46 and the pump outlet 48. Population of a data structure is shown at block 310 of FIG. 7.

From the block 310, the process may advance to block 320 to map the plurality of bore pressure values in the data structure to a plurality of inlet pressure values indicative of a pressure of the liquid at the pump inlet 46 and a plurality of pumping speed values indicative of a pumping speed of the pump 20. The mapping of the plurality of bore pressure values could include addressing the stored values in a map or lookup table having a first coordinate that includes inlet pressure or the inlet pressure values, a second coordinate that includes pumping speed or the pumping speed values, and a third coordinate that includes the bore pressure or bore pressure values. The mapping depicted at the block 320 may be such that the bore pressure according to the map varies in a manner that is dependent upon both the inlet pressure and the pumping speed, and the varying will typically be non-linear.

From the block 320, the process may advance to block 330 to generate a cavitation threshold model that includes or is otherwise based upon a subset (less than all) of the plurality of bore pressure values populating the data structure, and defines an operating curve for the pump. The model could include for example all the bore pressure values in the map that are associated with likely or possible cavitation or only those values that represent a cavitation threshold not to be crossed. Rather than relying upon pure theoretical calculations to determine what combinations of pumping speed and inlet pressure establish the safe operating zone for the pump 20, values predicted according to the above Equation 1 and also simulation or other modeling can be used to arrive at the subject model and pump operating curve. Accordingly, while the mapping of the plurality of bore pressure values to the inlet pressure values and the pumping speed values may occur according to the above Equation 1, in setting up the pump 20 and the pumping system 10 for service some adjustments can be made based upon simulations or other data sources. Such adjustments could additionally or alternatively be qualitative, and based upon input from a technician.

Figure 4:
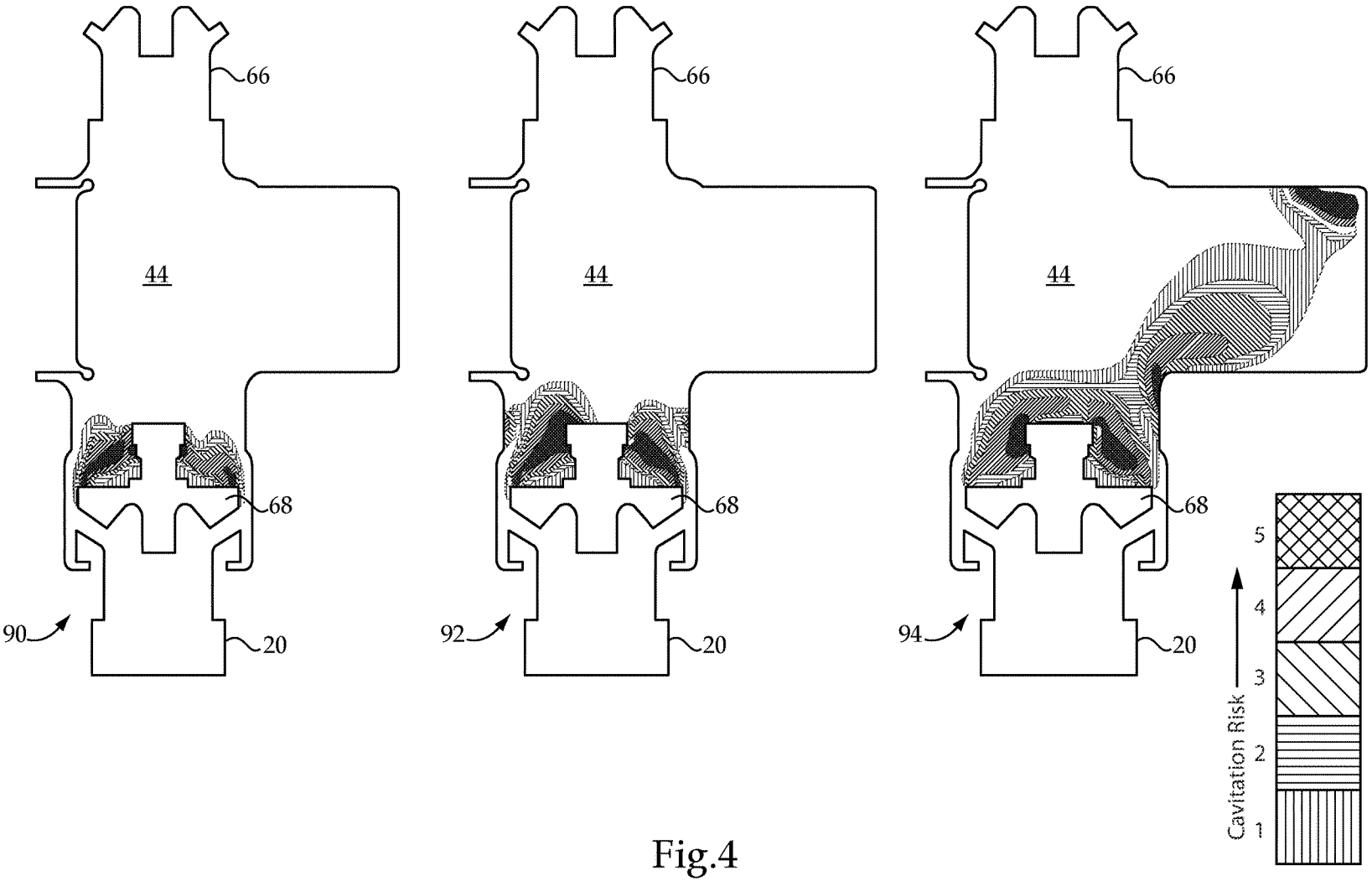
FIG. 4 includes diagrammatic illustrations of simulated conditions within a pump during several operating conditions.

To this end, referring now also to FIG. 4, there is shown a first simulated state 90 of the pump 20, a second simulated state 92, and a third simulated state 94. The simulated states 90, 92 and 94 can be produced according to known computational fluid dynamics (CFD) tools, and could represent a constant inlet pressure for the simulated states 90, 92, and 94, but variations in the pump speed. For instance, the simulated state 90 might be observed at a simulated pumping speed of about 180 RPM, the simulated state 92 might be observed at a simulated pumping speed of about 200 RPM, and the simulated state 94 might be observed at a simulated pumping speed of about 300 RPM. Simulated changes in inlet pressure, or changes in both inlet pressure and pumping speed, could also be utilized. The scale also shown in FIG. 4 can indicate a likelihood of cavitation occurring in the liquid within the bore 44 in each of the simulated states 90, 92, and 94. Not only can the general relationship between pumping speed and the likelihood of cavitation be seen from FIG. 4, but also expected locations at which the cavitation might occur in the pump 20 can be determined. Based upon the CFD tools and simulations applied, the validity of an operating curve for the pump 20 with respect to the likelihood of cavitation can be analyzed and adjustments made as necessary. Embodiments are contemplated where quantitative adjustments to the values inputted to a map are made. The cavitation threshold model may include bore pressure values quantitatively or qualitatively adjusted on the basis of CFD or other simulation or based upon the skill and experience of a technician presented with visual representations of various simulations.

Figure 5:
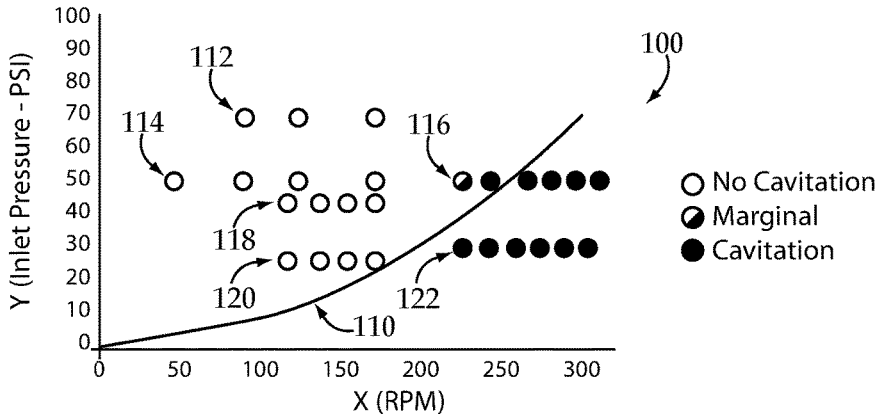
FIG. 5 is a graph illustrating a curve defined by bore pressure in a pump in relation to inlet pressure and pumping speed.

Referring also to FIG. 5, there is shown a curve 110 that represents bore pressure in relation to inlet pressure in pounds per square inch (PSI) on the Y-axis and pumping speed in RPM on the X-axis. It can be seen that the curve 110 has a non-linear shape. For other pump types and varying liquid types the shape of curve 110 could be quite different. The curve 110 could include a predicted threshold for cavitation in the pump 20, thus combinations of pumping speed and inlet pressure on the left side of the curve 110 could be considered to be within the cavitation safe zone, and combinations of pumping speed and inlet pressure on the right side of the curve 110 could be considered in the cavitation risk zone. Curve 110 may be an example pump operating curve as described herein. Also shown in FIG. 5 is a plurality of test runs that were performed to determine the validity of using the curve 110 as the operating curve for the pump 20. A legend is also included in FIG. 5, and indicates that open circles are data points associated with no observed cavitation, solid circles associated with observed cavitation, and half-filled circles associated with marginal or possible cavitation. Cavitation detection could take place by way of observations on the acceleration of structures of a pump housing, by way of acoustic detection techniques, in-bore sensors or still other techniques and combinations of techniques. The occurrence of cavitation could also be detected purely empirically by operating a pump under varying conditions, and then subsequently observing inside surfaces of the pump for the occurrence of cavitation damage. It can be seen that a first run 112 was associated with no cavitation, a second run 114 was associated with no cavitation, and likewise a run 118 and a run 120 also associated with no cavitation. Another run 116 included marginal cavitation and also likely actual cavitation, whereas likely cavitation was observed throughout another run 122. The experimental results depicted in FIG. 5 provided positive validation of the predicted pressure curve 110 as a pump operating curve for pump 20. In a practical implementation strategy, the pressure curve that is ultimately used in service could be modified slightly, such as made slightly steeper to prevent operating at the combinations of pumping speed and inlet pressure that yielded cavitation on the left side of the pressure curve 110 in the run 116. For purposes of setting up the pumping system 10 for operation, the values associated with curve 110 could be stored in a computer readable storage medium, and could be uploaded to such a medium in ECU 52 such that curve 110, and the cavitation threshold model of which curve 110 forms the whole or a part, is resident in the pumping system 10.

The present description is for illustrative purposes only, and should not be construed to narrow the breadth of the present disclosure in any way. Thus, those skilled in the art will appreciate that various modifications might be made to the presently disclosed embodiments without departing from the full and fair scope and spirit of the present disclosure. Other aspects, features, and advantages will be apparent upon an examination of the attached drawings and appended claims.

What is claimed is:

1. A method of operating a pumping system comprising:

moving a pumping element in a pump to transition a liquid between a pump inlet and a pump outlet in the pump;

receiving inlet pressure data indicative of an inlet pressure of the liquid at the pump inlet, and pumping speed data indicative of a pumping speed of the pump;

determining a pressure value based at least in part on the inlet pressure data and the pumping speed data that is indicative of a pressure of the liquid within a bore in the pump susceptible to cavitation of the liquid; and varying at least one of the pumping speed or the inlet pressure, responsive to the determined value;

wherein the receiving of inlet pressure data indicative of an inlet pressure of the liquid further includes receiving data from a pressure sensor exposed to the inlet pressure of the liquid, and wherein the pump includes a reciprocating pump having a rotatable crankshaft and the receiving of pumping speed data indicative of a pumping speed includes receiving data from a second sensor structured to monitor a parameter indicative of rotational speed of the rotatable crankshaft; and wherein the determining of the pressure value indicative of a pressure of the liquid within the bore includes determining a pressure value that is reduced relative to the inlet pressure according to the equation:

$$P_{bore}=P_{in}-[G]-[X]v^{7/4}_{plunger}-[Y]a_{plunger}-[Z]v^{2}_{plunger}$$

where:

$P_{bore}$=pressure in the bore;

$P_{in}$=inlet pressure;

v=plunger velocity;

a=plunger acceleration; and

G, X, Y, Z are numeric coefficients dependent upon at least one of a density of the liquid, a viscosity of the liquid, or a structural attribute of the pump.

2. The method of claim 1 wherein the pumping system includes a hydraulic fracturing rig having a mixer, and further comprising feeding a mixture containing the liquid and a proppant from the mixer to the pump.

3. The method of claim 2 wherein the varying of the at least one of the pumping speed or the inlet pressure includes varying the inlet pressure by way of varying an outlet pressure of the mixer.

4. The method of claim 1 further comprising outputting an activation signal to an operator alert device where the determined pressure value is indicative of expected cavitation of the liquid.

5. The method of claim 1 further comprising comparing the determined pressure value with a stored value that is based on a vapor pressure of the liquid.

6. The method of claim 5 wherein the stored value includes one of a plurality of stored values defining an operating curve for the pump.

7. The method of claim 1 wherein the determining of a pressure value that is indicative of a pressure of the liquid in the bore includes determining a plunger bore pressure value indicative of a pressure of the liquid within a plunger bore in the pump.

8. The method of claim 7 wherein the determining of a pressure value further includes reading the plunger bore pressure value from a map having an inlet pressure coordinate and a pumping speed coordinate.

9. A pumping system comprising:

a pump including a pumping element movable within a bore in a pump housing to transition a liquid between a pump inlet and a pump outlet in the pump housing;

a control system coupled with the pump and including a first monitoring mechanism structured to monitor a first parameter indicative of an inlet pressure at the pump inlet, a second monitoring mechanism structured to monitor a second parameter indicative of a pumping speed of the pump, and an electronic control unit;

the electronic control unit being coupled with each of the first monitoring mechanism and the second monitoring mechanism and structured to determine a pressure value indicative of a pressure of the liquid within the bore in the pump housing based at least in part on the inlet pressure and the pumping speed indicated by the first monitoring mechanism and the second monitoring mechanism, respectively;

the control system further including a cavitation alert device structured to produce an operator-perceptible alert indicative of expected cavitation of the liquid within the bore, and the electronic control unit being coupled with the operator alert device and structured to activate the operator alert device responsive to the determined value;

wherein the electronic control unit is further structured to determine the pressure value indicative of the pressure of the liquid within the bore based on values of the first parameter and the second parameter that satisfy the equation:

$$P_{bore}=P_{in}-[G]-[X]v^{7/4}_{plunger}-[Y]a_{plunger}-[Z]v^{2}_{plunger}$$

where:

$P_{bore}$=pressure in the bore;

$P_{in}$=inlet pressure;

v=plunger velocity;

a=plunger acceleration; and

G, X, Y, Z are numeric coefficients dependent upon at least one of a density of the liquid, a viscosity of the liquid, or a structural attribute of the pump.

10. The pumping system of claim 9 wherein the pumping system is part of a hydraulic fracturing rig including a power supply structured to power the pump, and a mixer structured to feed the liquid to the pump.

* * * * *